US005205433A

United States Patent [19]

Bitsch

[11] Patent Number: 5,205,433

[45] Date of Patent: Apr. 27, 1993

[54] WASTE-COLLECTING CONTAINER

[76] Inventor: Bartholomaeus Bitsch, Eckweg 15, W-6145 Lindenfels, Fed. Rep. of Germany

[21] Appl. No.: 839,106

[22] Filed: Feb. 20, 1992

[51] Int. Cl.[5] ..... B65F 1/14

[52] U.S. Cl. ..... 220/572; 220/367; 220/501; 220/627; 220/908; 220/913

[58] Field of Search ..... 220/367, 501, 571, 572, 220/627, 676, 908, 913, DIG. 6, DIG. 27

[56] References Cited

U.S. PATENT DOCUMENTS

| | | | |
|---|---|---|---|
| 496,917 | 5/1893 | Sweger | 220/908 X |
| 626,567 | 6/1988 | Robinson | 220/908 X |
| 1,058,205 | 4/1913 | Titus et al. | 220/908 X |
| 2,713,668 | 7/1955 | Thiele | 220/501 X |
| 3,074,583 | 1/1963 | Martinich, Jr. | 220/908 X |
| 4,105,412 | 8/1978 | Petzinger | 220/908 X |
| 4,108,609 | 8/1978 | Petzinger | 220/908 X |
| 4,294,379 | 10/1981 | Bard | 220/404 |
| 5,031,796 | 7/1991 | Schäfer et al. | 220/571 |
| 5,036,999 | 8/1991 | Bitsch | 220/627 |

FOREIGN PATENT DOCUMENTS

| | | | |
|---|---|---|---|
| 566741 | 8/1960 | Belgium | 220/908 |
| 0271719 | 6/1988 | European Pat. Off. . | |
| 374360 | 6/1990 | European Pat. Off. | 220/908 |
| 386568 | 9/1990 | European Pat. Off. | 220/908 |

*Primary Examiner*—Allan N. Shoap
*Assistant Examiner*—Stephen Cronin
*Attorney, Agent, or Firm*—Flynn, Thiel, Boutell & Tanis

[57] ABSTRACT

A waste-collecting container for compostable waste, in which the interior consists of two spaces arranged one above the other, the lower space having the purpose of collecting a liquid from the compostable waste and the capability of discharging such liquid. This space is thereby, on the one hand, sufficiently large in order to be able to reliably receive the accumulating liquid, on the other hand, the emptying of both the liquid area and also of the waste container itself is to take place easily and without any problems associated with the waste becoming again mixed with the liquid. The lower space is for this purpose separated by a fork-like grate from the remainder of the container housing, which grate is usually arranged horizontally, however, during emptying pivots about an axle which is horizontally oriented in the container housing. A reliable separation of solid and liquid waste and their complete emptying out of the waste-collecting container is, in this manner, assured.

10 Claims, 1 Drawing Sheet

WASTE-COLLECTING CONTAINER

FIELD OF THE INVENTION

The invention relates to a waste-collecting container for compostable waste, in particular for collecting of household garbage or the like, essentially consisting of an upper lid and a lower container housing composed of an upstanding wall part and a bottom wall and closeable by means of the lid, and including a space in the region of the bottom wall separated from the interior of the container housing, which space is designed to receive the liquid contained in the waste.

BACKGROUND OF THE INVENTION

A known waste-collecting container is generally known from the inventor's earlier published DE-OS 3939511 (corresponding to U.S. Pat. No. 5,036,999). This publication teaches a number of technical features that assures that the compostable waste stored in the container housing is most of all well relieved from the liquid it contains in order to guarantee a rotting supported more by aerobic bacteria. It is among others provided for this purpose that the liquid is collected in the region of the bottom wall of the container housing and that care is taken that it can—at least partly —flow directly out of the container housing and/or can evaporate through a ventilating element provided on the back wall of the container housing. In order to achieve this, a trough-like insert is provided which partitions off a (very small) part of the container housing volume for liquid removal. The bottom of the trough-like insert is ribbed in order to achieve, on the one hand, a stable form with respect to the stored waste and to gain, on the other hand, indeed a space for the separated liquid which reaches the space through recesses at the bottom of the insert.

Such a structural arrangement is fully functional; however, it also has disadvantages. Thus, the space available for collecting the liquid is relatively small and is no longer sufficient in particular when liquid removal from the container housing is disturbed, for example, when the discharge channel in the area of the bottom part thereof, is clogged, especially with waste that is particularly loaded with liquid. To empty such a waste-collecting container can also cause difficulties. Thus, it is conceivable that the trough-like insert separates from the region of the bottom wall during a tipping of the waste-collecting container. There also exists the risk that even when the insert remains stationary in the waste-collecting container, residues of waste under or within the insert are not dumped out.

Thus, the purpose of the invention is to provide a waste-collecting container of the type identified in detail above which can also receive large amounts of liquid and to simultaneously assure that the mechanical task of emptying of this waste-collecting container takes place smoothly and completely.

SUMMARY OF THE INVENTION

The purpose is attained according to the invention by the space being separated from the remaining interior portion of the container housing by a fork-like grate which lies in a horizontal plane in the normal position thereof, by the fork-like grate being pivotal in direction of the lid about a horizontal axle provided adjacent a back wall of the container housing and extending parallel to the back wall and resting on stationary supports on the container housing. The arrangement is thereby such that the grate is pivotal through an approximate right angle.

A substantially larger space for collecting the liquid is in this manner created in the region of the bottom wall of the waste-collecting container than has been possible up to now. With this it is first assured that the waste stored in the collecting container can be well drained. When the waste-collecting container is emptied, the grate pivots under the influence of gravity toward the back wall of the container housing so that even waste parts which slipped through the grate into the separated space can now be poured out of the container housing. The grate returns then into its normal position when the waste-collecting container is set up straight again.

The pivotal grate can actually be supported in any desired manner; however, if the support occurs on the ventilating element insertable into the container housing, then the grate forms a structural unit with the ventilating element, which unit only need be inserted into the waste-collecting container. It is also possible, depending on the type of waste to be stored, to keep different types of grates on hand or to equip different waste-collecting containers with different grates. The expense is definitely warranted because a good precomposting of the waste can occur in this manner.

BRIEF DESCRIPTION OF THE DRAWINGS

The details and further advantages of the invention will be discussed in greater detail hereinafter in connection with the drawings and one exemplary embodiment, in which.

DESCRIPTION DETAILED

Figure 1:
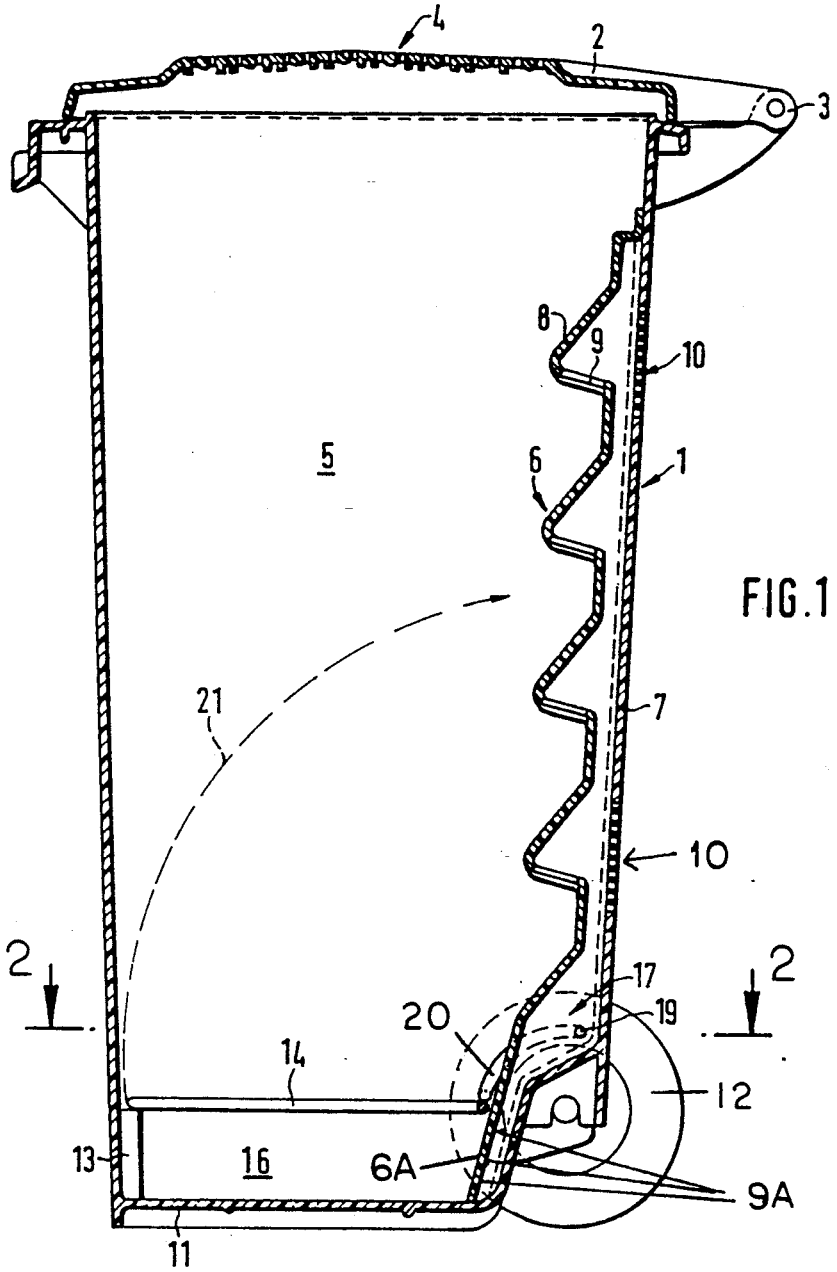
FIG. 1 is a longitudinal cross-sectional view of a waste-collecting container of the invention.

FIG. 1 shows first of all a container housing 1 and a lid 2, which are the main parts of the wastecollecting container. The lid 2 is connected by a hinge 3 to the container housing 1 and has a number of openings 4 used to ventilate the interior 5 of the container housing. A ventilating element 6 is releasably fastened to the back wall 7 of the container housing 1; it has projections 8 which are each equipped with air slots 9 to ventilate the waste stored in the interior 5 of the container housing. Openings 10 assuring a ventilating to the surroundings are provided in the back wall 7. As shown in the inventor's earlier publication mentioned above, the lower end of the ventilating element is open to the space 16. In this particular embodiment, the ventilating element 6 has plural openings 9A at the lower end of a frontwardly facing wall 6A thereof facilitating access by the space 16 to the openings 10 in the back wall 7 of the container housing 1. It is to be recognized that the ventilating element in the earlier publication could, if desired, be substituted for the one shown in FIG. 1. This makes it possible to sufficiently and adequately ventilate the waste-collecting container independent of the amount of stored waste.

Figure 2:
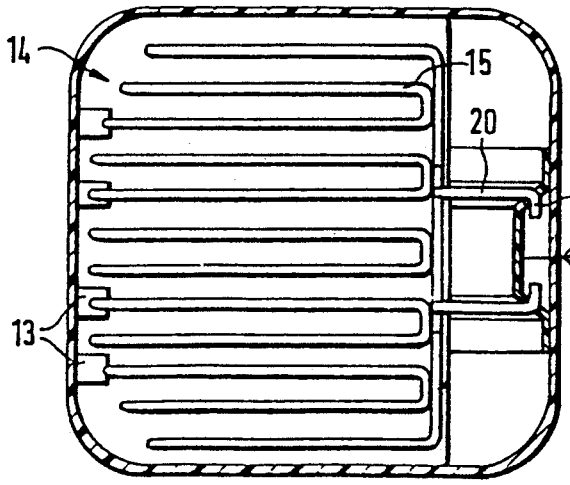
FIG. 2 is a cross-sectional view taken along the line 2—2 of FIG. 1.

In the region of the bottom wall 11, near the back wall 7 of which the common transport rollers 12 are also easily rotatably supported, there are provided, adjacent a front wall, support members 13 on which the free ends of the grate rods or tines 15 of a grate 14 is supported when the waste-collecting container is in an upright position. The grate 14 is then approximately horizontally arranged. FIG. 2 shows a top view of the grate. The grate has in the special arrangement of the exemplary embodiment the general configuration of a coke fork with its outer periphery, in the top view, conforming approximately to the contour of the interior walls of the interior 5 of the container housing 1. The grate 14 is composed of individual, back wall to front wall extending, parallel grate rods or tines 15 all connected together only at their respective common ends. The grate 14 separates the space 16 between the grate and the bottom wall 11 from the interior portion 5. The space 16 is the collecting receptacle for the liquid contained in the waste.

The grate 14 is pivotal about an axle generally designated at 17 adjacent the back wall 7 of the container housing 1 and the aforesaid common ends of said tines. The axle 17 is formed by two stub axles 18 stationarily provided on the grate 14, extend horizontally and are otherwise approximately parallel to the back wall 7. The stub axles 18 are received in bearing holes 19 advantageously provided on the side walls of the ventilating element 6. The stub axles 18 are actually the bent ends of two wire rod-like legs 20, the spacing of which is slightly greater than the width of the ventilating element 6. A direction arrow 21 makes it clear that the grate 14 is pivoted about the axles 18 in direction of the ventilating element 6 during an emptying of the waste-collecting container and thereby frees the entire bottom area of the container housing 1 so that same can also be emptied. Further, collected waste clinging to the tines can freely slide off the free ends of the tines when the container housing is upended during an emptying of the waste container.

The invention is not to be limited to the described exemplary embodiment; in particular the shape and the construction of the grate 14 and the cross sections of its grate rods or tines 15 can be chosen relatively freely. It must, however, be assured that the grate 14 can carry out the identified pivoting during an emptying of the waste-collecting container under the influence of gravity.

The embodiments of the invention in which an exclusive property or privilege is claimed are defined as follows:

1. A waste-collecting container for compostable waste, comprising an open top container housing and an upper lid therefor, said open top container housing having means defining an upstanding wall and a bottom wall connected to said upstanding wall, grate means separating a bottom space in the region of said bottom wall from an upper interior space inside of said container housing, said bottom space being adapted to receive any liquid that may be container in the waste, said grate means comprising a fork-like grate which includes a plurality of spaced and generally parallel tines all connected together only adjacent their respective common ends, and pivot means for pivotally securing said grate means to said upstanding wall at a location adjacent said common ends of said plural tines and for movement between a first position wherein said tines are generally parallel to said bottom wall for separating said bottom space from said upper interior space and a second position wherein said tines becomes oriented generally parallel to said upstanding wall, said free ends of said tines, when said grate means is in said second position, being closer to said open top of said container housing than when said grate means is in said first position thereof so that when said waste-collecting container is upended for purposes of dumping collected compostable waste, said grate means will pivot to said second position to enable said compostable waste to slide freely off said tines, past said free ends thereof.

2. The waste-collecting container according to claim 1, wherein the grate is pivotal through an approximate right angle.

3. The waste-collecting container according to claim 1, wherein said pivot means is defined by two stub axles stationarily provided on said fork-like grate, said stub axles being rotatably supported in bearing holes in said container housing.

4. The waste-collecting container according to claim 3, wherein said bearing holes are provided in a ventilating element arranged on said upstanding wall.

5. The waste-collecting container according to claim 4, wherein a lower end of said ventilating element terminates in said bottom space.

6. The waste-collecting container according to claim 1, wherein said grate means includes means defining a horizontally extending axle adjacent said common ends of said tines, said horizontally extending axle being connected to said upstanding wall through bearing means provided on said upstanding wall.

7. The waste-collecting container according to claim 6, wherein said open top container housing has a polygon cross section in a plane parallel to said bottom wall and, consequently, plural connected upstanding walls, wherein said open top container housing includes a hinge means on one of said upstanding walls for pivotally securing said lid to said container housing adjacent said open top thereof, wherein said bearing means are provided on said one upstanding wall, and wherein supporting elements are provided on at least one other upstanding wall to support said grate means in said first position thereof.

8. The waste-collecting container according to claim 7, wherein a ventilating means is arranged on said one upstanding wall for providing an air venting passageway between said bottom space and an exterior region of said container housing adjacent said open top of said container housing.

9. The waste-collecting container according to claim 8, wherein said horizontally extending axle is defined by two stub axles, said stub axles being received in bearing holes provided in said ventilating means.

10. The waste-collecting container according to claim 9 wherein said bearing holes are axially aligned arcuate slots.

* * * * *

UNITED STATES PATENT AND TRADEMARK OFFICE

CERTIFICATE OF CORRECTION

PATENT NO. : 5,205,433

DATED : April 27, 1993

INVENTOR(S) : Bartholomaeus BITSCH

It is certified that error appears in the above-identified patent and that said Letters Patent is hereby corrected as shown below:

On title page, insert the following:

---[30] Foreign Application Priority Data

March 6, 1991 [DE] Germany.....G 91 02 660.1---.

Signed and Sealed this

Third Day of May, 1994

*Attest:*

*Attesting Officer*

Bruce Lehman

BRUCE LEHMAN

*Commissioner of Patents and Trademarks*